US008028747B2

(12) United States Patent
Hata et al.

(10) Patent No.: US 8,028,747 B2
(45) Date of Patent: Oct. 4, 2011

(54) TUBE SPACER, METHOD OF MANUFACTURING THE SAME, AND HEAT EXCHANGER

(75) Inventors: Hidenori Hata, Hyogo (JP); Kozo Uehara, Hyogo (JP); Kazuhiro Kimura, Hyogo (JP); Noriyuki Kuribayashi, Hyogo (JP); Koji Shimomura, Hyogo (JP)

(73) Assignee: Noritz Corporation, Hyogo (JP)

( * ) Notice: Subject to any disclaimer, the term of this patent is extended or adjusted under 35 U.S.C. 154(b) by 923 days.

(21) Appl. No.: 11/987,312

(22) Filed: Nov. 29, 2007

(65) Prior Publication Data

US 2008/0149315 A1 Jun. 26, 2008

(30) Foreign Application Priority Data

Dec. 20, 2006 (JP) ..... 2006-342495

(51) Int. Cl.
*F28F 9/00* (2006.01)
*F28F 1/30* (2006.01)

(52) U.S. Cl. ..... 165/182; 165/67

(58) Field of Classification Search ..... 165/162, 165/151, 171, 182, 184, 67
See application file for complete search history.

(56) References Cited

U.S. PATENT DOCUMENTS

| | | | | | |
|---|---|---|---|---|---|
| 2,268,680 | A * | 1/1942 | Von Linde | 165/184 |
| 2,620,170 | A * | 12/1952 | Brickman | 165/171 |
| 4,337,827 | A * | 7/1982 | Jabsen | 165/172 |
| 4,655,282 | A * | 4/1987 | Roffelsen | 165/184 |
| 6,192,976 | B1 * | 2/2001 | Yoshida et al. | 165/171 |
| 7,322,403 | B2 * | 1/2008 | Agee | 165/109.1 |

FOREIGN PATENT DOCUMENTS

| | | | |
|---|---|---|---|
| JP | 55-014984 | A | 2/1980 |
| JP | 05340685 | A * | 12/1993 |
| JP | 2540034 | Y2 | 4/1997 |
| JP | 2001-174171 | A | 6/2001 |
| WO | WO-2005/108875 | A1 | 11/2005 |

* cited by examiner

*Primary Examiner* — Tho V Duong
(74) *Attorney, Agent, or Firm* — Rader, Fishman & Grauer PLLC

(57) ABSTRACT

A tube spacer S formed by bending a wire, includes a plurality of projections 20 and a base-bending portion 21. Each of the projections 20 is inserted between tubes, and has a pair of extending portions 201 extend in X direction and a front-bending portion 202 for connecting both front ends of the pair of extending portions 201. The base-bending portion 21 connects both rear ends of the projections 20 so that the projections 20 are arranged at interval in Z direction. With this structure, manufacturing cost for the tube spacer S can be low, and the tubes can be stably supported.

7 Claims, 12 Drawing Sheets

TUBE SPACER, METHOD OF MANUFACTURING THE SAME, AND HEAT EXCHANGER

BACKGROUND OF THE INVENTION

1. Field of the Invention

The present invention relates to a tube spacer for arranging heat transfer tubes of a heat exchanger or other tubes at predetermined intervals, a method of manufacturing the tube spacer, and a heat exchanger with the tube spacer.

2. Description of the Related Art

An example of tube spacer is shown in FIG. 14 (Japanese examined utility model No. 25400343). The tube spacer 9A shown in FIG. 14 is formed a meandering shape by bending a wire rod, and has a plurality of straight portions 91 at intervals via clearances 90. A plurality of heat transfer tubes 94 are inserted individually in clearances 90. With this structure, the tube spacer 9A arranges the heat transfer tubes 94 at predetermined intervals. Since the tube spacer 9A is formed from a wire rod, the manufacturing cost is low.

However, the above-described conventional structure has the following problems.

The spacer 9A is bent the wire rod like a mere meander. Therefore, when the heat transfer tubes 94 is secured, the heat transfer tubes 94 should be inserted into clearance 90 in axial direction (the heat transfer tube 94 should be inserted in perpendicular direction to paper surface in FIG. 14). As a result, such insertion is not easy. Although it is convenient that the tube spacer 9A can be inserted from one side of the heat transfer tubes 94, such operation is difficult. Also, the tube spacer 9A is held in contact with the heat transfer tube 94 at merely a point. Therefore, this structure is not stable to support the heat transfer tube 94.

FIG. 15 shows another example of conventional tube spacer (PCT/WO2005/108875). As shown in FIG. 15, the tube spacer 9B has a structure that a plurality of projections 93 is provided on a side of a base plate 92.

According to this spacer 9B, the projections 93 are inserted between desired tubes (not shown) from one side of the tubes, and the clearances of the same to thickness of the projections 93 can be formed between the tubes. The tubes are stably supported because the contact area of the projections 93 and the tubes is large.

However, the cost of the tube spacer 9B is comparatively high because the tube spacer 9B is made of plate material. An example of heat exchanger has a structure that includes a plurality of heat transfer tubes for recovering heat from combustion gas passes through between the heat transfer tubes. When the tube spacer 9B is used for this heat exchanger, the flow of combustion gas is disturbed because the base plate 92 and the projections 93 are wide and combustion gas is interrupted to flow by the base plate 92 and projections 93. Such a phenomenon is not preferable in view of heat exchange efficiency.

SUMMARY OF THE INVENTION

An object of the present invention is to solve or lessen the above-described problems of the conventional structure.

According to a first aspect of the present invention, there is provided a tube spacer formed by bending a wire rod, comprising a plurality of projections formed from a plurality of portions of the wire rod and inserted between tubes, and a base-bending portion formed from the other portion of the wire rod. X, Y and Z directions are perpendicular to each other. Each of the projections comprises a pair of extending portions and a front-bending portion, the paired extending portions are spaced from each other in the Y direction and extend in the X direction, and the front-bending portion connects both front ends of the pair of extending portions. The base-bending portion connects both rear ends of the projections so that the projections are arranged at interval in the Z direction.

Preferably, the plurality of projections are overlapped to each other in the X and Y directions and form a line in the Z direction.

Preferably, the wire rod is made of metal and the sectional shape of the wire rod is circle.

Preferably, the front-bending portion is a substantial semicircle shape and each of the projections is a substantial U-shape.

Preferably, the base-bending portion is a substantial semicircle shape, and both ends of the base-bending portion are connected to two adjoining rear ends of the projections.

Preferably, both rear ends of the projections located at opposite ends in the Z direction are formed to substantial L-shape.

According to a second aspect of the present invention, there is provided a method of manufacturing a tube spacer comprising a step of forming a meandering material having a structure in which a plurality of extending portions extending in a width direction are arranged at intervals in a vertical direction and a plurality of bending portions connecting ends of the plurality of extending portions by bending a wire rod, and a step of folding the meandering material along a centerline in the width direction so that a half portion of the meandering material approaches the other half portion.

According to a third aspect of the present invention, there is provided a heat exchanger comprising a plurality of heat transfer tubes and a tube spacer for forming clearances between the heat transfer tubes and formed by bending a wire rod. The tube spacer comprises a plurality of projections formed from a plurality of portions of the wire rod and inserted between the heat transfer tubes and a base-bending portion formed from the other portion of the wire rod. X, Y and Z directions are perpendicular to each other. Each of the projections comprises a pair of extending portions and a front-bending portion, the paired extending portions are spaced from each other in the Y direction and extend in the X direction, and the front-bending portion connects both front ends of the pair of extending portions. The base-bending portion connects both rear ends of the projections so that the projections are arranged at interval in the Z direction.

Other features and advantages of the present invention will become more apparent from description of embodiments of the present invention given below with reference to the accompanying drawings.

DETAILED DESCRIPTION OF THE PREFERRED EMBODIMENTS

Preferred embodiments of the present invention will be described below in detail with reference to the accompanying drawings.

FIG. 1 and FIGS. 2A to 2C show an example of tube spacer according to the present invention. In these drawings, X, Y, and Z directions are perpendicular to each other. Both the X and Y directions are horizontal and the Z direction is vertical.

Figure 1:
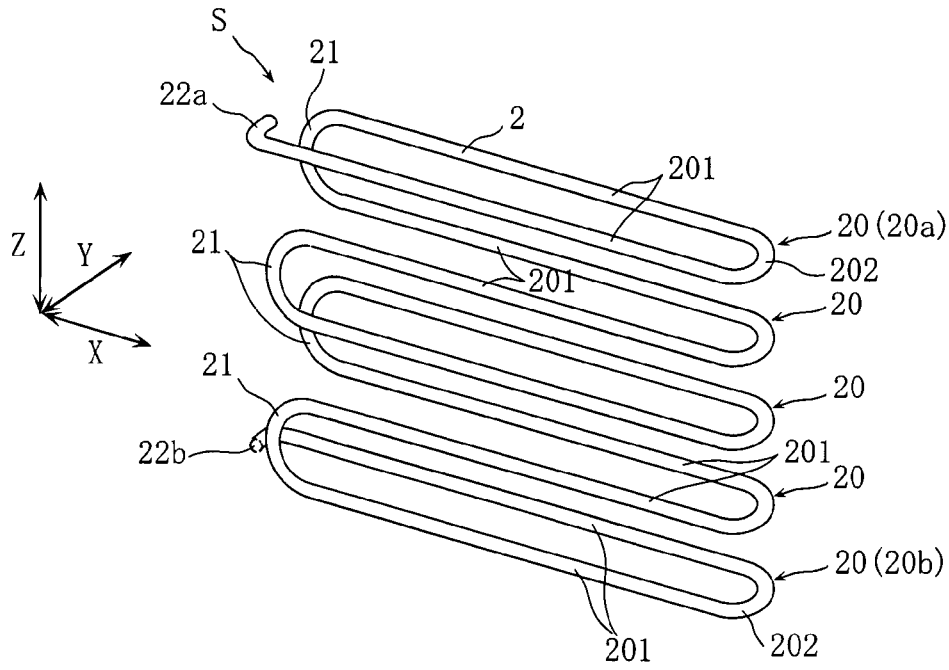
FIG. 1 is a perspective view showing an example of tube spacer according to the present invention.
Figure 2A:
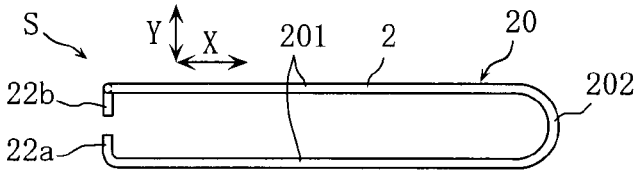
FIG. 2A is a plan view of the tube spacer shown in FIG. 1.
Figure 2B:
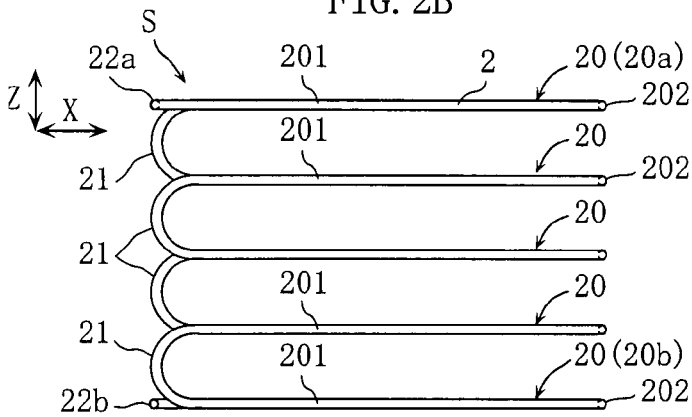
FIG. 2B is a front view thereof.
Figure 2C:
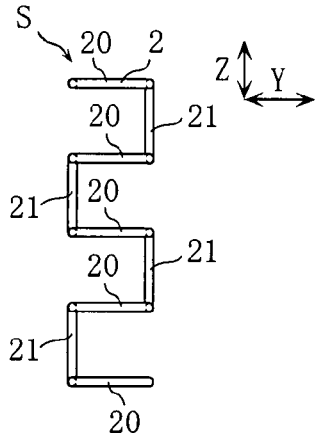
FIG. 2C is right side view thereof.

As clearly shown in FIG. 1, the tube spacer S is formed by bending a metal wire rod 2 such as one having a diameter of about few millimeters and a circular section, and includes a plurality of projections 20 aligned at intervals in the Z direction, and a plurality of base-bending portions 21 for connecting them.

The respective projections 20 are portions to be inserted between desired tubes as described later. As clearly shown in FIG. 2A, each projection 20 is in a substantially U shape, and has a pair of extending portions 201 extending in the X direction at an interval in the Y direction, and a semicircular front-bending portion 202 connecting front ends of the pair of extending portions 201. The plurality of projections 20 are substantially similar in shape and size.

Each base-bending portion 21 is in a semicircular shape connecting rear ends of the extending portions 201 of the two projections 20 adjacent in the Z direction. The plurality of base-bending portions 21 are provided in staggered arrangement in Y and Z directions as clearly shown in FIG. 2C. As a result, the plurality of projections 20 overlap one another in such a manner that no part of them protrudes too far in the X and Y directions, and are aligned in a line in the Z direction.

At rear ends of the extending portions 201 not formed with the base-bending portions 21 of the two projections 20 (20*a*, 20*b*) positioned at upper and lower ends, substantially L-shaped bending portions 22*a*, 22*b* are formed. These bending portions 22*a*, 22*b* are used for positioning and fixing of the tube spacer S as described later.

Next, an example of method of manufacturing the tube spacer S will be described.

Figure 5A:
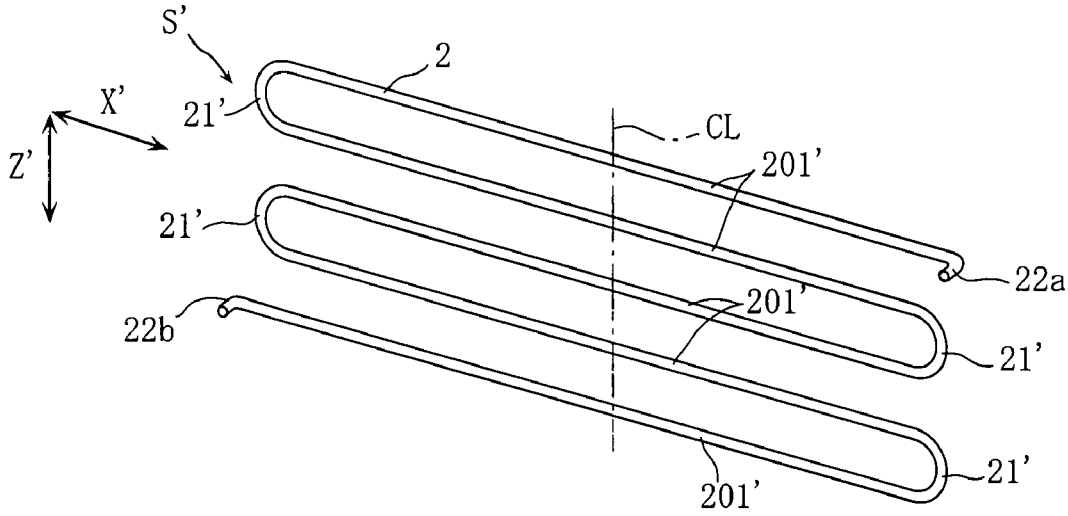
FIGS. 5A and 5B are perspective view showing a method of manufacturing of the tube spacer shown in FIG. 1 and FIGS. 2A to 2C.
Figure 5B:
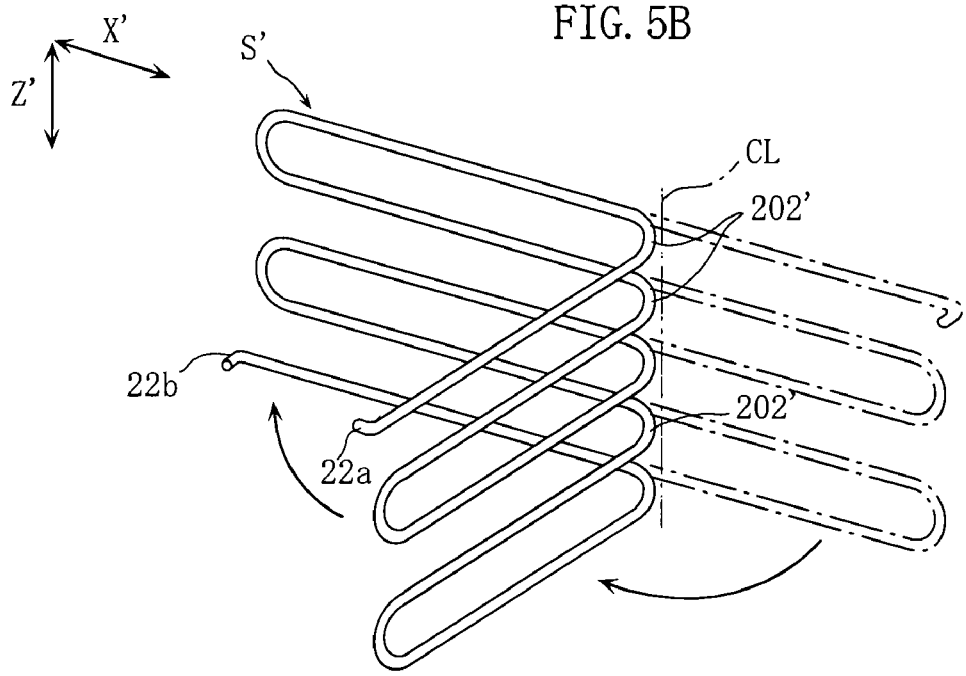

First, as shown in FIG. 5A, by bending the wire rod 2, a meandering material S' is manufactured. The meandering material S' has a structure in which a plurality of extending portions 201' extending in a width direction (an X' direction) are aligned at intervals in a vertical direction (a Z' direction) and a plurality of bending portions 21' connecting ends of the plurality of extending portions 201' are provided in staggered arrangement. The bending portions 22*a*, 22*b* can be formed in advance when the meandering material S' is formed. After the meandering material S' is manufactured, the meandering material S' is bent along a center line CL of a width thereof as shown in FIG. 5B. By such bending, a right half portion and a left half portion of the meandering material S' are opposed and brought close to each other. In this way, the tube spacer S can be manufactured. Bending portions 202' at the center of the meandering material S' become the front-bending portions 202 of the tube spacer S.

According to such a manufacturing method, it is possible to properly manufacture the tube spacer S with fewer processes and easier work.

Next, operation of the tube spacer S will be described.

Figure 3:
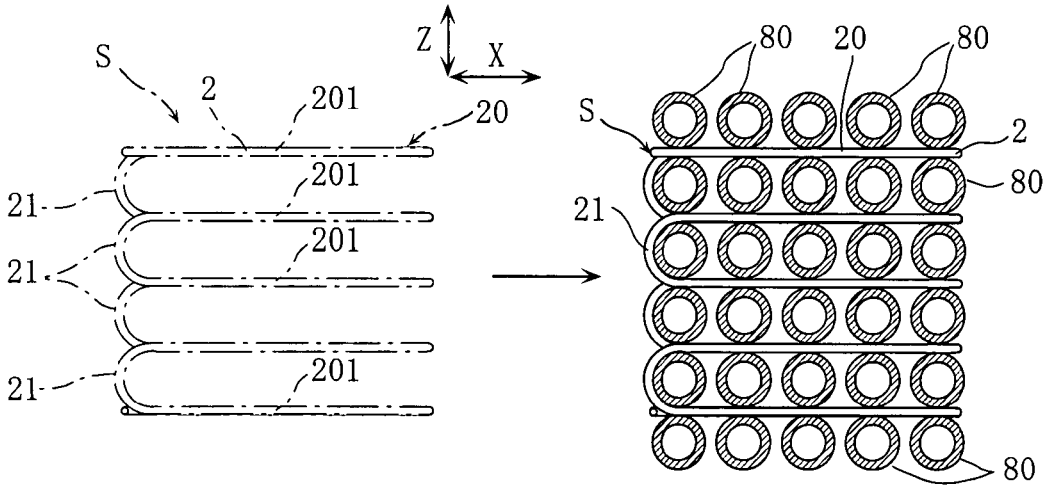
FIG. 3 is a sectional view showing an example of operation of the tube spacer shown in FIG. 1 and FIGS. 2A to 2C.

As shown in FIG. 3, in a state where a plurality of tubes 80 are arranged in the X and Z directions, the respective projections 20 of the tube spacer S are inserted between the plurality of tubes 80 from one side of the tubes 80. As a result, the plurality of tubes 80 are supported while forming clearances between them in the Z direction, the clearances being equal to a diameter of the wire rod 2. Therefore, to set the clearances between the tubes 80 in the Z direction to a desired dimension, the wire rod 2 having a diameter of the dimension may be used and it is possible to easily and accurately set the dimension of the clearances between the tubes 80. Furthermore, the tube spacer S can be set by only inserting the respective projections 20 between the tubes 80 from one side of the tubes 80 as described above and such work is easy to be done. Moreover, the respective base-bending portions 21 are in semicircular shapes corresponding to outer peripheral faces of the tubes 80 and therefore inner peripheral faces of the respective base-bending portions 21 can be brought in close contact with the outer peripheral faces of the tubes 80. In this way, the respective base-bending portions 21 do not protrude too far off the tubes 80 laterally.

Figure 4:
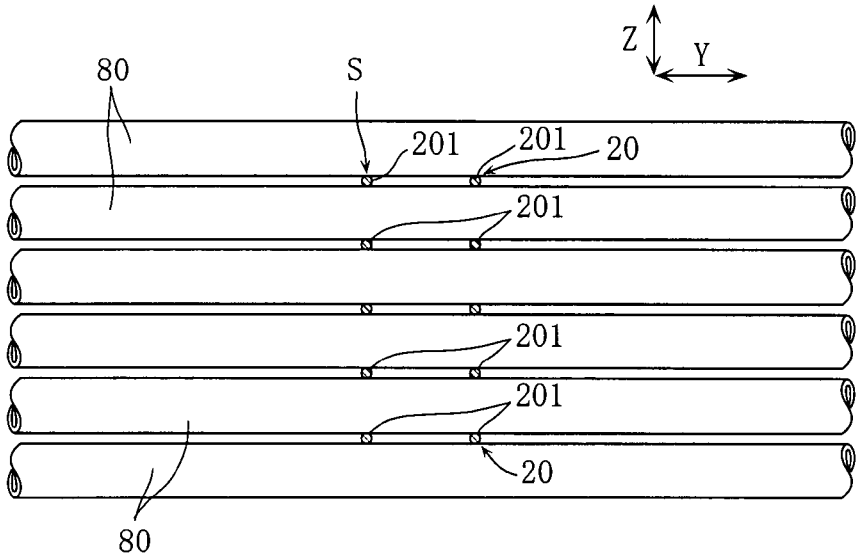
FIG. 4 is a side sectional view showing a principal portion of FIG. 3.

As clearly shown in FIG. 4, the pair of the extending portions 201 of the tube spacer S are positioned at an interval in the Y direction between the tubes 80, and one projection 20 is in contact with each tube 80 at two points. Therefore, the tube spacer S can stably support the tubes 80, though it is formed by using one wire rod 2. Since the tube spacer S is formed with the wire rod 2, it does not obstruct the clearances formed between the tubes 80 with a large area. Therefore, when combustion gas is passed through the clearances between the tubes 80 and the tubes 80 carry out heat recovery, it is possible to satisfactorily avoid serious interruption of a flow of the combustion gas by the tube spacer S. Since the plurality of projections 20 are aligned in a line in the Z direction, the overall width of the tube spacer S can be reduced to suppress a mounting space of the tube spacer S.

FIGS. 6 to 13 show an example of heat exchanger using the tube spacers S, a water heater including the heat exchanger, and structures related to them.

Figure 6:
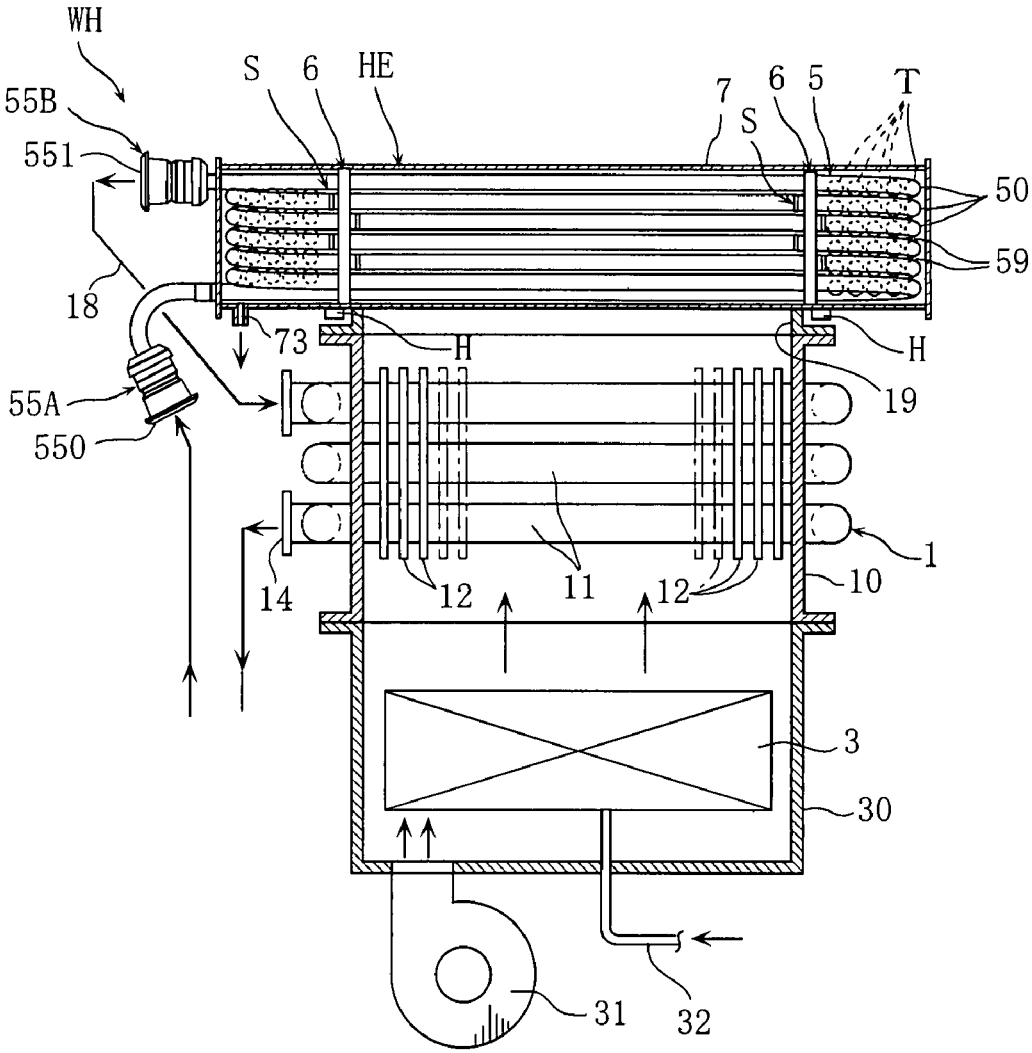
FIG. 6 is a schematic sectional view showing an example of heat exchanger and water heater incorporating the heat exchanger according to the present invention.

As clearly shown in FIG. 6, the water heater WH includes a burner 3, a first heat exchanger 1, and a second heat exchanger HE. The second heat exchanger HE corresponds to the one example of the heat exchanger according to the present invention. The plurality of tube spacers S are mounted in the second heat exchanger HE.

The burner 3 is a gas burner, for example, and is disposed in a casing 30 into which combustion air is supplied from a fan 31. The burner 3 burns fuel gas supplied from outside through a fuel pipe 32. The first heat exchanger 1 is for recovering sensible heat from the combustion gas generated by the burner 3 and has a structure in which heat transfer tubes 11 having a plurality of fins 12 are disposed in a casing 10.

Figure 7:
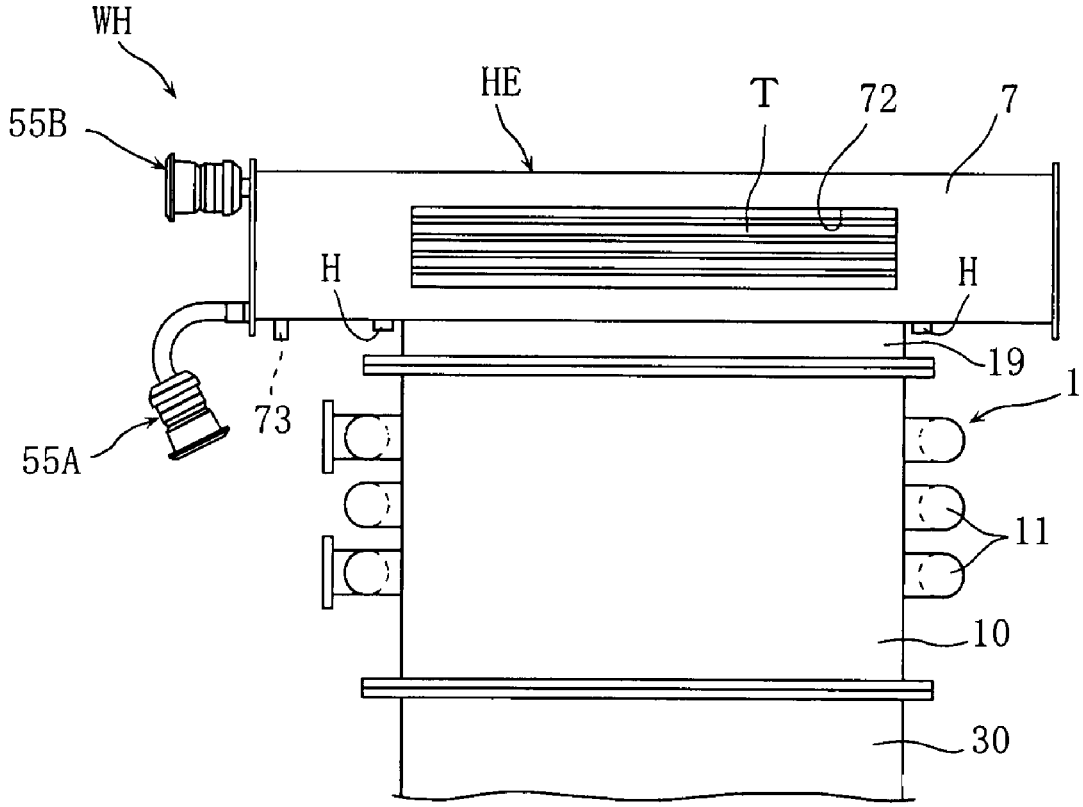
FIG. 7 is a front view showing a principal portion of the water heater shown in FIG. 6.

The second heat exchanger HE is for recovering latent heat from the combustion gas from which the sensible heat has been recovered by the first heat exchanger 1, and is disposed above the first heat exchanger 1 and is connected to the casing 30 through an auxiliary casing 19. The second heat exchanger HE includes a casing 7 and a plurality of heat transfer tubes T, and the plurality of heat transfer tubes T have a plurality of helical tubes 5 housed in the casing 7. As clearly shown in FIG. 8, a rear wall 70*a* and a front wall 70*b* of the casing 7 are respectively provided with an air supply opening 71 and an exhaust opening 72 for the combustion gas. The combustion gas that has passed through the first heat exchanger 1 passes through an inside of the auxiliary casing 19, enters the casing 7 through the air supply opening 71, and passes through clearances 59 between the plurality of helical tubes 5. The respective clearances 59 are formed by using the plurality of tube spacers S, and heat recovery is carried out when the combustion gas passes through the respective clearances 59 as described later. The combustion gas that has gone through the heat recovery is exhausted to outside from the casing 7 through the exhaust opening 72. The exhaust opening 72 is in a substantially rectangular shape as shown in FIG. 7, for example, and the air supply opening 71 is in a similar shape. When the latent heat is recovered from the combustion gas by the helical tubes 5, drain (condensate water) is generated on surfaces of the tubes 5 and drops on a bottom wall 70*d* of the casing 7. The bottom wall 70*d* is inclined forward and a front portion of the bottom wall 70*d* is provided with a discharge opening 73 for the drain. The drain that has dropped from the helical tubes 5 onto the bottom wall 70*d* flows into the discharge opening 73 and discharged outside the casing 7.

Figure 9:
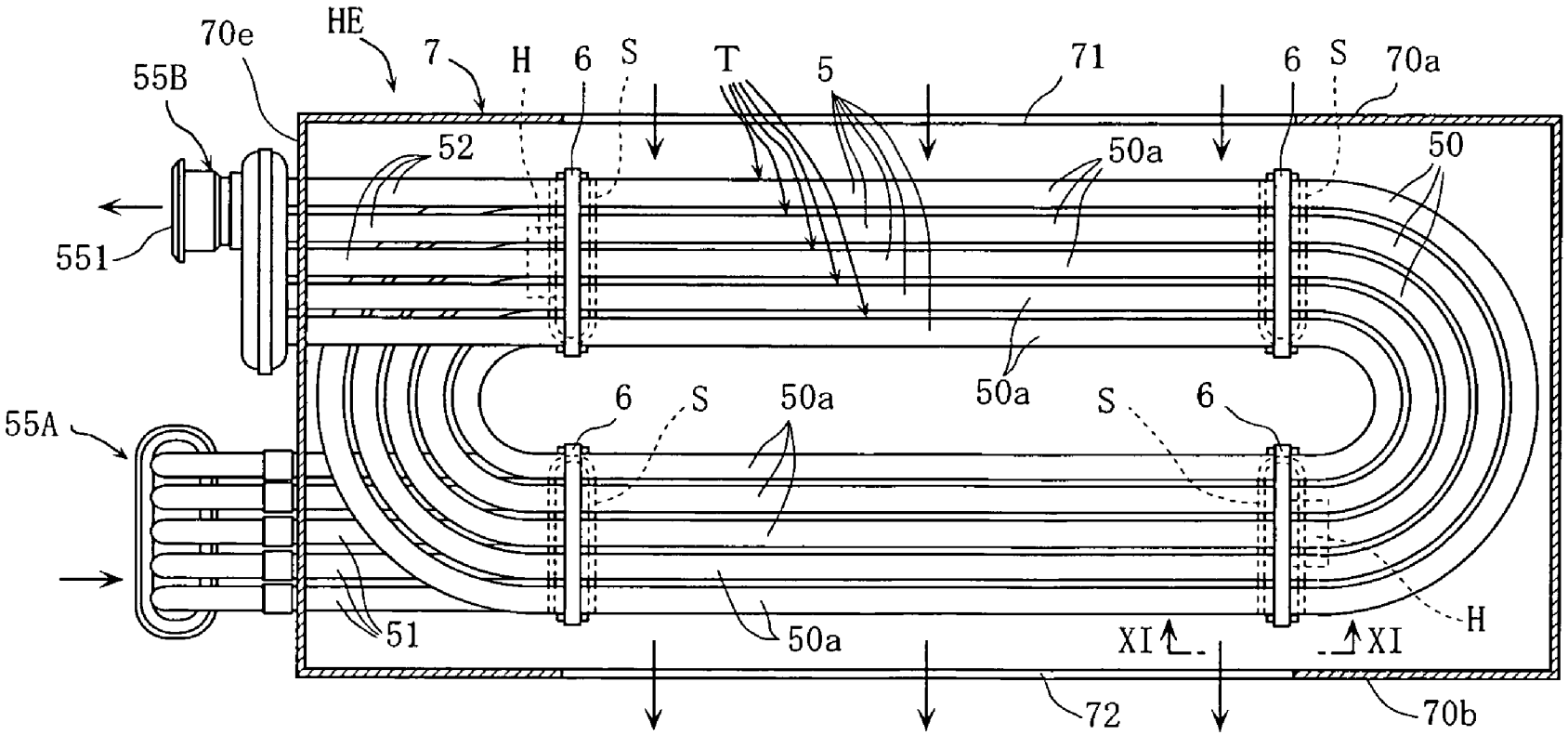
FIG. 9 is a horizontal sectional view showing a second heat exchanger of the water heater shown in FIG. 6 to 8.
Figure 10:
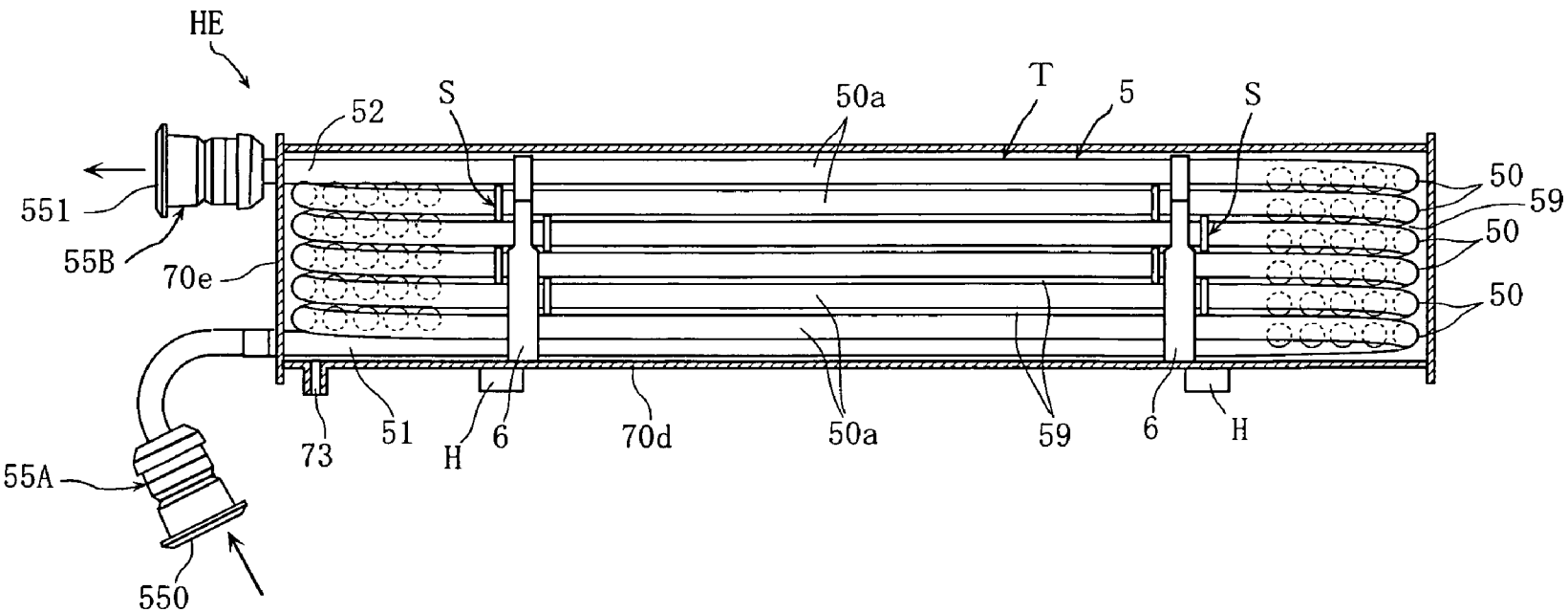
FIG. 10 is a front sectional view of the second heat exchanger shown in FIG. 9.

As clearly shown in FIGS. 9 and 10, the plurality of helical tubes 5 have a structure in which a plurality of substantially oval loop portions 50 connected in series are piled in a vertical direction while leaving the plurality of clearances 59 there between. The respective loop portions 50 of the plurality of helical tubes 5 are different in size and are substantially concentrically disposed in a lap winding manner. Extending portions 51, 52 connected to upper and lower ends of the plurality of helical tubes 5 penetrate one side wall 70*e* of the casing 7 to be drawn out of the casing 7 and coupled to headers 55A, 55B as an inlet and an outlet. As clearly shown in FIG. 6, in the water heater WH, when water flows into an inlet opening 550 of the header 55A, the water is heated while passing through the helical tubes 5 of the respective heat transfer tubes T. Then, the water flows from an outlet opening 551 of the header 55B into the heat transfer tubes 11 through a connecting pipe 18, and is heated again. Thereafter, the heated hot water flows out of an outlet opening 14 and is supplied to a desired destination through an appropriate pipe (not shown).

As means for fixing and mounting the plurality of heat transfer tubes T in the casing 7, a plurality of sets of support bodies 6 are used in addition to the plurality of tube spacers S. As shown in FIG. 9, these tube spacers S and the support bodies 6 are provided to support four positions of an area where a plurality of straight portions 50*a* extending in a width direction of the casing 7 of the plurality of helical tubes 5 are aligned, for example. In each of the helical tubes 5, while the straight portions 50*a* are substantially horizontal, semicircular bending portions connected to ends of the straight portions 50*a* are not horizontal but inclined. A mounting structure of the tube spacer S to the plurality of helical tubes 5 is similar to that described with reference to FIGS. 3 and 4, and the projections 20 are inserted between the straight portions 50*a*. As a result, the above-described the plurality of clearances 59 for passage of the combustion gas are formed.

Figure 12:
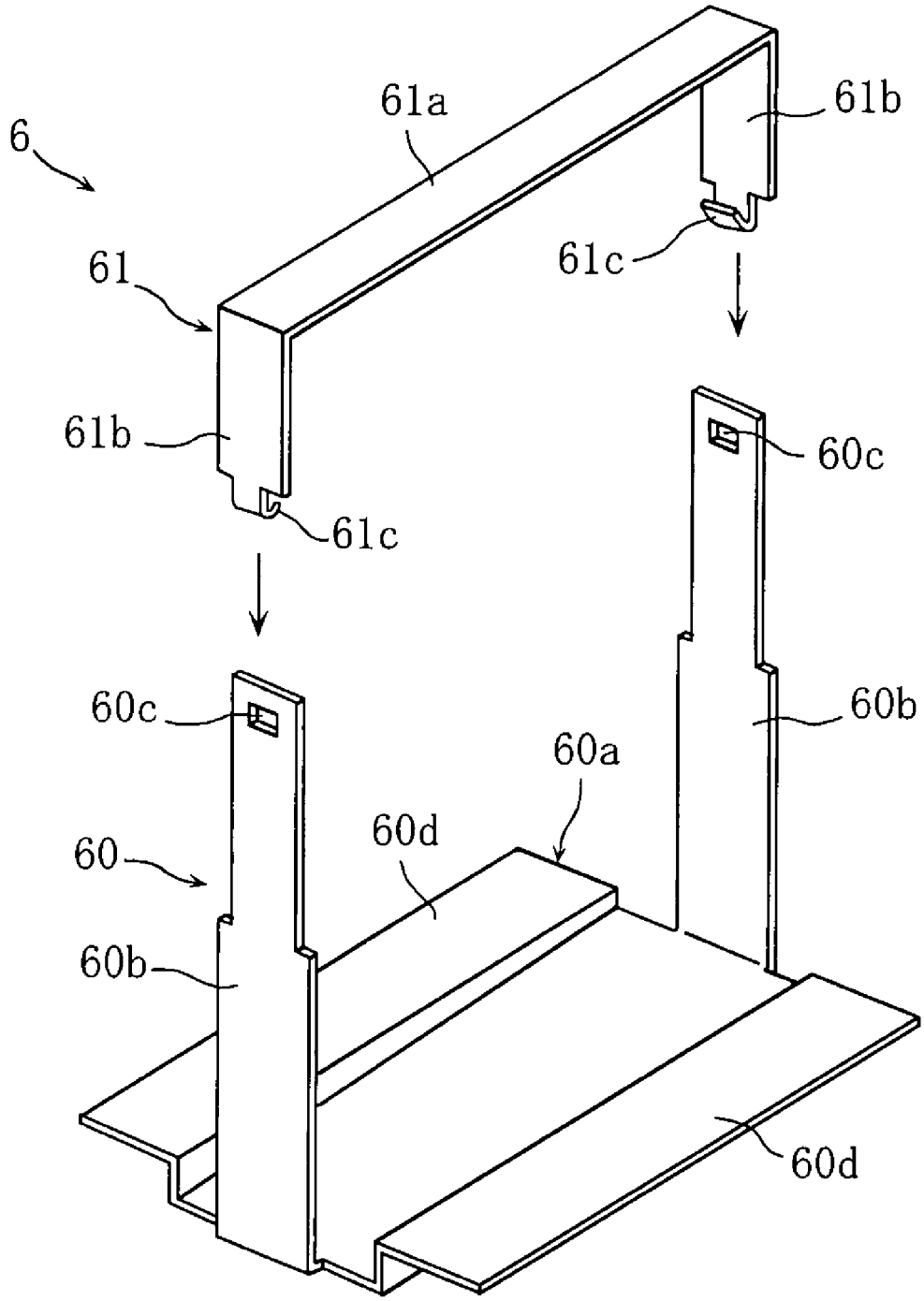
FIG. 12 is an exploded perspective view of a support body for the second heat exchanger shown in FIG. 9.

Each of the support bodies 6 is made of stainless steel, for example, and includes a main body portion 60 and an auxiliary portion 61 formed separately from each other as shown in FIG. 12. The main body portion 60 has a shape in which a pair of standing strips 60*b* stand upward from opposite ends of a width of a base portion 60*a*. The auxiliary portion 61 has a pair of protruding strips 61*b* protruding downward from longitudinal opposite ends of a substantially horizontal belt-shaped portion 61*a*. An upper portion of each standing strip 60*b* and a front end of a lower end of each protruding strip 61*b* are provided with a hole 60*c* and a protrusion 61*c*. By engaging them with each other, it is possible to assemble the base portion 60*a* and the auxiliary portion 61 into a substantially rectangular frame.

Figure 8:
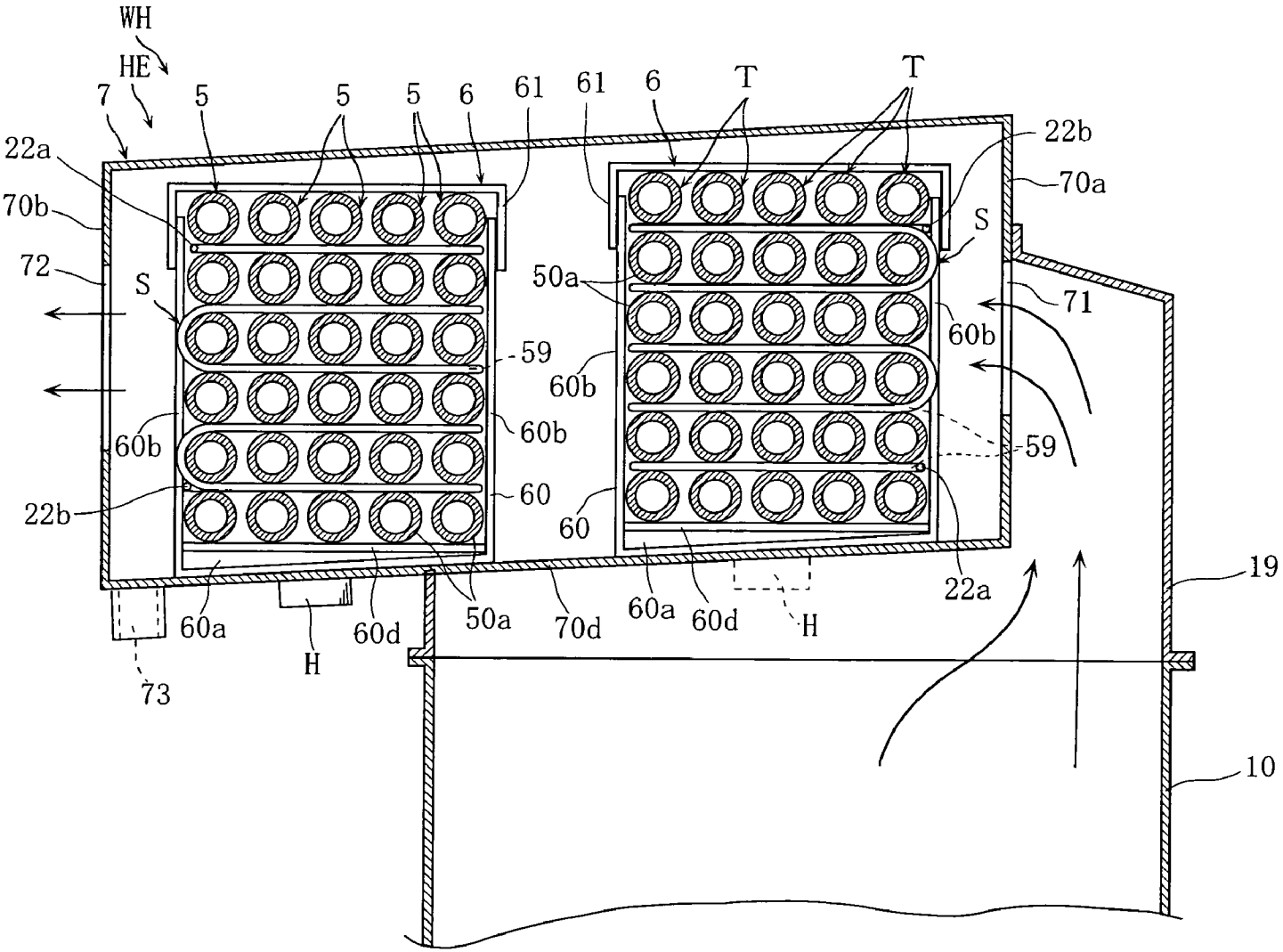
FIG. 8 is a sectional view showing a principal portion of the water heater shown in FIG. 6.
Figure 11:
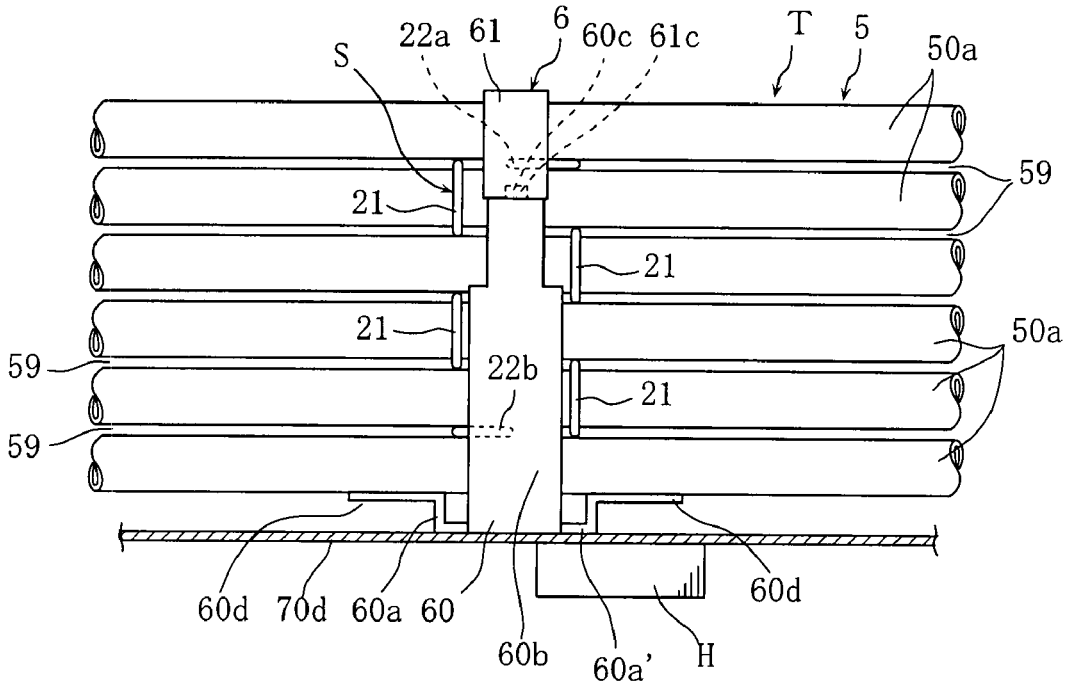
FIG. 11 is a sectional view taken along the line XI-XI in FIG. 9.

As shown in FIGS. 8 and 11, the base portion 60*a* is fixed to an upper face of the bottom wall 70*d* of the casing 7. Welding is used as fixing means, for example. The plurality of straight portions 50*a* are disposed between the pair of standing strips 60*b* of the base portion 60*a* and, as a result, positional displacement of the straight portions 50*a* in a front-rear direction (left-right direction in FIG. 8) of the casing 7 is prevented. Since the bottom wall 70*d* of the casing 7 is inclined forward as described above, the base portion 60*a* has a thickness increasing forward corresponding to the inclination and has a pair of substantially horizontal receiving plate portions 60*d* (see FIGS. 11 and 12). The straight portions 50*a* positioned at the lowermost end are placed on the receiving plate portions 60*d* and therefore are supported in substantially horizontal attitudes. The auxiliary portion 61 of the support body 6 is mounted to an upper portion of the base portion 60*a* to prevent the plurality of straight portions 50*a* from lifting upward.

Figure 13:
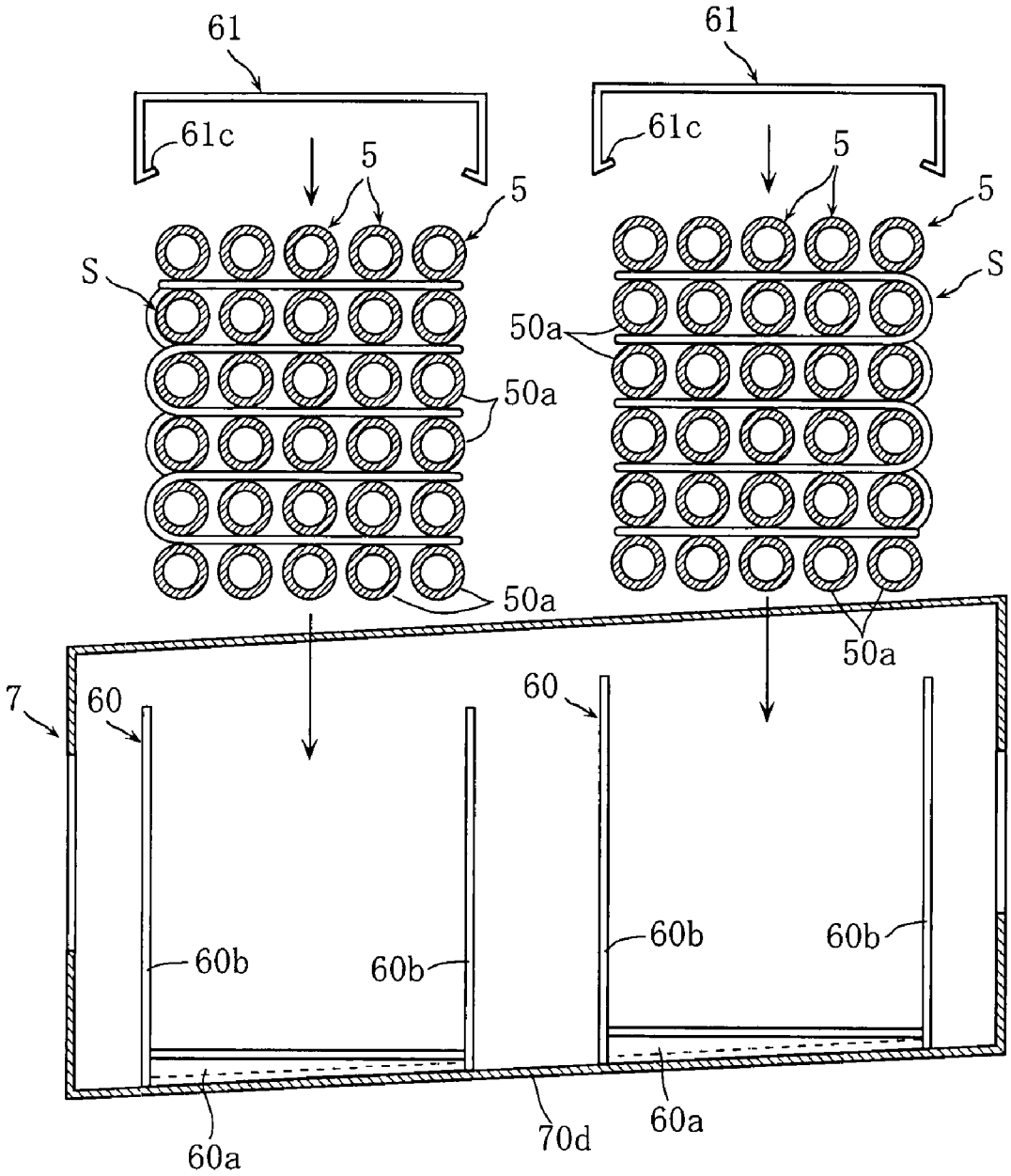
FIG. 13 is an exploded sectional view of the second heat exchanger shown in FIG. 9.
Figure 14:
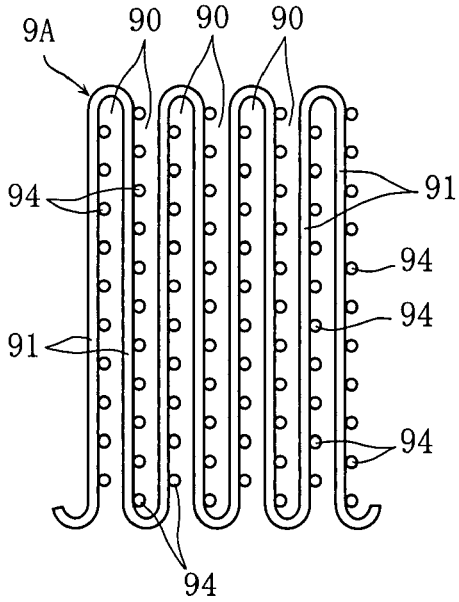
FIG. 14 PRIOR ART
FIG. 14 schematically shows an example of conventional structure.
Figure 15:
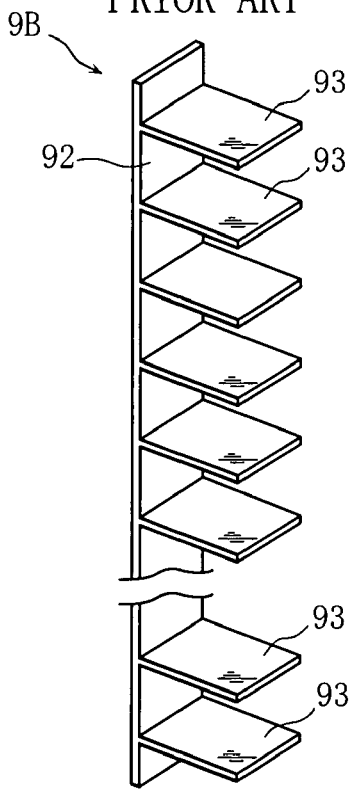
FIG. 15 PRIOR ART
FIG. 15 schematically shows another example of conventional structure.

To manufacture the second heat exchanger HE, as shown in FIG. 13, for example, the main body portion 60 of each of the support bodies 6 is first fixed and mounted onto the bottom wall 70*d* of the casing 7 in a state where an upper face portion of the casing 7 is opened. Next, the plurality of helical tubes 5 to which the tube spacer S has been mounted in advance are housed in the casing 7. At this time, the straight portions 50*a* are disposed between the pair of standing strips 60*b* of the main body portion 60. Then, by engaging and mounting the auxiliary portion 61 with and to the pair of standing strips 60*b*, it is possible to surround the plurality of straight portions 50*a* with the entire support body 6. The upper face opening portion of the casing 7 is then closed.

The tube spacer S is disposed so that the base-bending portions 21 are positioned on opposite sides of the standing strip 60*b*, for example, as shown in FIG. 11. In this way, when the tube spacer S receives a force for moving the spacer S in a left-right direction of the drawing, the base-bending portions 21 come into contact with the standing strip 60*b*, and positional displacement of the tube spacer S in the above-described direction can be prevented. The upper and lower two bending portions 22*a*, 22*b* of the tube spacer S are disposed inside the standing strip 60*b* to face an inner face of the standing strip 60*b*. With such a structure, when the tube spacer S tries to recede in an opposite direction to a direction of insertion with respect to the straight portions 50*a*, the bending portions 22*a*, 22*b* come into contact with the standing strip 60*b* and such recession is prevented. Therefore, it is possible to appropriately prevent disengagement of the tube spacer S from the helical tubes 5.

Electric heaters H are mounted at positions or around the positions of a lower face of the bottom wall 70*d* of the casing 7 directly under the main body portions 60 of the support bodies 6. The heaters H are driven when an outside air temperature drops to a predetermined temperature and a fear of freezing in the heat transfer tubes T arises in a case where the water heater WH is installed in a cold region and operation for hot-water supply is stopped. Heat of the heaters H is transferred to the plurality of heat transfer tubes T via a part of the bottom wall 70*d* of the casing 7 and the support bodies 6.

In the second heat exchanger HE, since the tube spacers S are used while being combined with the support bodies 6, it is possible to appropriately form the clearances 59 of the desired dimension between the loop portions 50 of the plurality of heat transfer tubes T, and to appropriately position the plurality of loop portions 50 in desired positions in the casing 7. Besides, when the heaters H are driven, the heat of the heaters H is transferred to the plurality of heat transfer tubes T via the support bodies 6. Therefore, it is possible to satisfactorily prevent freezing of the heat transfer tubes T without disposing the heaters H in the casing 7. Because the tube spacers S are in contact with the support bodies 6 and also in individual contact with the plurality of heat transfer tubes T, the tube spacers S also perform the function of transferring the heat from the heaters H to the plurality of heat transfer tubes T.

The present invention is not limited to the above-described embodiment.

A length and a thickness of the wire rod in the present invention are not specifically determined. A bar-like member or a similar member having a relatively large diameter also belongs to the wire rod in the present invention. Although a sectional shape of the wire rod is preferably a circle, it is not limited thereto but may be a rectangle or other shape. Moreover, the wire rod may be a hollow tube. Each of the projections may be formed into substantially V shape instead of substantially U shape. The pair of extending portions may be parallel or may not be parallel. The front-bending portion of each projection may not be semicircular. It is essential only that the pair of extending portions is basically extending in a predetermined X direction and it does not necessarily have to be straight. The number of projections is not specifically determined if two or more projections are provided. The base-bending portions of the tube spacer may be formed in a shape other than the semicircle. The tube spacer according to the present invention can be used not only for arranging straight heat transfer tubes without helical tubes but also for arranging tubes other than the heat transfer tubes. The X, Y, and Z directions in the present invention are not limited to horizontal and vertical directions.

The heat exchanger according to the present invention may be formed not only as the heat exchanger for recovering latent heat but also as the heat exchanger for recovering sensible heat. The heat transfer tubes forming the heat exchanger are not limited to tubes through which hot water passes, and may be tubes for exchanging heat with a heat medium other than the combustion gas.

The invention claimed is:

1. A tube spacer formed by bending a wire rod for forming clearances between a plurality of tubes, comprising:

a plurality of projections formed from a plurality of portions of the wire rod and used for insertion between the tubes; and a base-bending portion formed from the other portion of the wire rod;

wherein X, Y and Z directions are perpendicular to each other, the X direction being a direction into which the projections are inserted between the tubes, the Y direction being a direction into which the tubes extend, and the Z direction being a direction into which the tubes are aligned;

wherein each of the projections comprises a pair of extending portions and a front-bending portion, the paired extending portions are spaced from each other in the Y direction and extend in the X direction, and the front-bending portion connects both front ends of the pair of extending portions; and wherein the base-bending portion connects both rear ends of the projections so that the projections are arranged at interval in the Z direction.

2. The tube spacer according to claim 1, wherein the plurality of projections are overlapped to each other in the X and Y directions and form a line in the Z direction.

3. The tube spacer according to claim 1, wherein the wire rod is made of metal and the sectional shape of the wire rod is circle.

4. The tube spacer according to claim 1, wherein the front-bending portion is a substantial semicircle shape and each of the projections is a substantial U-shape.

5. The tube spacer according to claim 1, wherein the base-bending portion is a substantial semicircle shape, and both ends of the base-bending portion are connected to two adjoining rear ends of the projections.

6. The tube spacer according to claim 1, wherein both rear ends of the projections located at opposite ends in the Z direction are formed to substantial L-shape.

7. A heat exchanger comprising a plurality of heat transfer tubes and a tube spacer for forming clearances between the heat transfer tubes and formed by bending a wire rod, wherein the tube spacer comprises:

a plurality of projections formed from a plurality of portions of the wire rod and used to be inserted between the heat transfer tubes; and a base-bending portion formed from the other portion of the wire rod;

wherein X, Y and Z directions are perpendicular to each other, the X direction being a direction into which the projections are inserted between the tubes, the Y direction being a direction into which the tubes extend, and the Z direction being a direction into which the tubes are aligned;

wherein each of the projections comprises a pair of extending portions and a front-bending portion, the paired extending portions are spaced from each other in the Y direction and extend in the X direction, and the front-bending portion connects both front ends of the pair of extending portions; and wherein the base-bending portion connects both rear ends of the projections so that the projections are arranged at interval in the Z direction.

* * * * *